US006943687B2

(12) United States Patent
Lee et al.

(10) Patent No.: US 6,943,687 B2
(45) Date of Patent: Sep. 13, 2005

(54) PIR MOTION DETECTOR FOR A DECORATIVE LANTERN

(75) Inventors: Wade Lee, Danville, CA (US); Donald R. Sandell, San Jose, CA (US)

(73) Assignee: EML Technologies LLC, Danville, CA (US)

( * ) Notice: Subject to any disclaimer, the term of this patent is extended or adjusted under 35 U.S.C. 154(b) by 159 days.

(21) Appl. No.: 10/383,818

(22) Filed: Mar. 7, 2003

(65) Prior Publication Data

US 2003/0179091 A1 Sep. 25, 2003

Related U.S. Application Data

(60) Provisional application No. 60/362,753, filed on Mar. 7, 2002.

(51) Int. Cl.[7] ..... G08B 13/18

(52) U.S. Cl. ..... 340/556; 340/541; 340/552; 340/565; 362/276; 362/257; 362/802; 250/338.1; 250/342

(58) Field of Search ..... 340/556, 541, 340/565, 567, 552; 362/276, 257, 802; 250/338.1, 342

(56) References Cited

U.S. PATENT DOCUMENTS 5,282,118 A * 1/1994 Lee ..... 362/276
5,406,083 A * 4/1995 Sandell et al. ..... 250/353
5,434,764 A * 7/1995 Lee et al. ..... 362/276
5,442,532 A * 8/1995 Boulos et al. ..... 362/276
5,453,622 A * 9/1995 Sandell et al. ..... 250/353
5,575,557 A * 11/1996 Huang et al. ..... 362/276
5,590,953 A * 1/1997 Haslam et al. ..... 362/276
5,626,417 A * 5/1997 McCavit ..... 362/276
5,886,821 A 3/1999 Sohn
6,323,488 B1 11/2001 McCavit et al.
6,348,691 B1 * 2/2002 Sandell et al. ..... 250/353
6,376,840 B1 4/2002 Ko
6,479,823 B1 11/2002 Strang et al.

* cited by examiner

*Primary Examiner*—Jeffery Hofsass
*Assistant Examiner*—Daniel Previl
(74) *Attorney, Agent, or Firm*—Elliot B. Aronson

(57) ABSTRACT

A small-sized hidden motion detector that can be incorporated in a decorative manner into a decorative lantern. The motion detector can be incorporated into lighting fixture designs not previously amenable to a hidden motion detector in the body of the lighting fixture. A small decorative motion detector housing is provided defining a compact interior region with a PIR sensor mounted inside and providing a sufficient optical pathway for a practical motion detector of wide angular field of view that can nevertheless fit inside commonly found small-sized decorative lantern elements. In one embodiment the motion detector is hidden in a small generally cylindrical decorative element of the sort that is found in a number of traditional decorative lantern designs and that has not previously been amenable to a hidden motion detector. Another embodiment includes a mechanism for mechanically adjusting the range and responsiveness of the motion detector notwithstanding the small size of the space available for housing the detector.

14 Claims, 4 Drawing Sheets

PIR MOTION DETECTOR FOR A DECORATIVE LANTERN

This application claims the benefit of provisional application No. 60/362,753 filed Mar. 7, 2002.

BACKGROUND OF THE INVENTION

The present invention relates to passive infrared motion detectors of the type used in residential outdoor lighting fixtures, for example, to illuminate a walkway or driveway when a person or automobile approaches. The invention is more particularly directed to an arrangement for making the motion detector an inconspicuous element of the lighting fixture and to an arrangement for adjusting the motion detector range.

Early passive infra-red motion detectors used for activating outdoor lighting fixtures were big and bulky. They were only used with floodlights or with other non-decorative, primarily utilitarian lighting. The motion detectors of that time were contained in a separate, bulky and conspicuous housing that was unsuitable for use with stylish decorative lanterns commonly mounted in a prominent position by the front door of a house to welcome visitors. Later, an inexpensive flexible plastic lens was developed—the so-called flexible segmented Fresnel lens—that enabled more compact and less conspicuous motion detectors to be designed. Once the motion detectors had evolved to be smaller and less obtrusive, they started to be used with decorative lighting fixtures as well.

Decorative lighting fixtures have a rich heritage apart from motion detectors that stems from centuries of technical advancement and artistic creativity. There are many styles available to consumers today that have their origins in earlier lanterns designed for non-electric lighting. The earliest lanterns had an open bowl that held a lamp fuel such as animal fat or grease, tallow or oil and a wick extending out of the bowl. This lamp, used for centuries, evolved from a primitive utilitarian lamp to a highly refined decorative lantern as craftsmen made changes to incorporate functional and stylistic advances. For example, over the centuries the wick arrangement was configured so that excess oil or fat would drain back into the bowl instead of dripping onto the ground; the open bowl was reconfigured with a hinged cover with wick outlet; multiple wicks were added; arrangements were devised for carrying and hanging the lantern; and the lantern was crafted from such materials as iron, copper, bronze, pewter and silver, each material permitting its own decorative styling. Over time new fuels were introduced, each with its own characteristic technical requirements that stimulated changes in lantern design to meet the needs of the new fuel. New designs evolved for such fuels as whale oil, the so-called burning fluids (alcohol, alcohol and turpentine blends, camphene), coal oil, kerosene, and gas. Notable inventions influenced lantern designs as well—the Argand burner for whale oil, the von Welsbach mantle for gas, and of course the incandescent electric light. Perhaps more than by technical advancement, lantern styles have been influenced by the aesthetic creativity of artisans over the centuries, who developed imaginative designs complementing the fashionable architectural styles of the period. The result is that the consumer today is confronted with a profuse selection of lanterns—lighting purveyors typically offer them in categories of style such as Colonial, Victorian, Art Nouveau, Arts and Crafts, Mission, English Tudor, Queen Anne, Georgian Revival, Spanish, Mediterranean, and Contemporary, to mention only a few—conveying impressions of old world charm, geographic association, or architectural period and incorporating stylistic lines from centuries of development. Only a relatively few of the available lantern styles lend themselves to building in an inconspicuous motion detector.

When motion detectors were first used with outdoor decorative lanterns, they were located in a small housing mounted on the lantern backplate. The backplate is an intermediate plate to which the lantern is attached and which in turn is mounted on a wall over an electrical junction box. Such a backplate-mounted motion detector is illustrated in FIG. 1 of U.S. Pat. No. 5,590,953 of Haslam et al. This arrangement became commercially feasible because of the segmented Fresnel lens, which permitted the motion detector housing to be sufficiently compact that it diminished the distraction from the decorative nature of the lighting fixture. With a backplate-mounted motion detector a large number of lantern styles could be motion-activated. The presence of the motion detector was nevertheless plainly evident, and some lantern styles could not be used with the backplate-mounted motion detector because a portion of the lantern necessarily extended in front of the motion detector and blocked the motion-detecting action.

In recent years the trend has been to integrate the motion detector into the decorative lantern itself and thus remove it from the backplate. Early integrated decorative fixtures simply added a decoratively shaped element to house the motion detector. This often took the form of a cylinder of expanded diameter and may be seen for example in FIG. 2 of U.S. Pat. No. 5,590,953 of Haslam et al. While this form of design provided a decorative lantern with integrated motion detector, it could not be incorporated into most of the classic and contemporary lantern styles without interfering with the original style, if it could be incorporated at all.

A first undertaking to incorporate the motion detector into a classic lantern style is disclosed in U.S. Pat. Nos. 5,282,118 and 5,434,764 of Lee et al. In these patents the motion detector is hidden in a generally spherical, but somewhat flattened housing, which is of a general form that has been found in lantern styles for several centuries and which originally served as an oil reservoir in oil-burning lamps. This integrated motion detector preserved the classic lantern style without noticeably compromising the outward appearance.

Despite these developments there still exist a plethora of historic and contemporary decorative lantern styles that are not amenable to a hidden motion detector in the fixture body. Problems arise when the motion detector is incorporated into the body of the lantern because there is limited space for the optical and electronic elements and because the interior volume available for the motion detector elements may be awkwardly shaped. The volume of the space to work with and the shape of the decorative exterior fixture walls impose constraints on the technical design of the motion detector. To add a motion detector to many stylistic lantern designs, it has been necessary either to add a further housing element to the lantern, adversely altering the lantern style, or to place the motion detector on the backplate. To date, many such historical and contemporary styles have had to go without integrated motion detectors.

SUMMARY OF THE INVENTION

The present invention provides a motion detector in a decorative lighting fixture, the motion detector being of small size, and particularly of small transverse dimension, which permits the motion detector to be incorporated into lighting fixture designs not previously amenable to a hidden motion detector in the body of the lighting fixture. A small decorative motion detector housing is provided defining a compact interior region with a PIR sensor mounted inside and providing a sufficient optical pathway for a practical motion detector of wide angular field of view that can nevertheless fit inside commonly found small-sized decorative lantern elements. In one embodiment the motion detector is hidden in a small generally cylindrical decorative element of the sort that is found in a number of traditional decorative lantern designs and that has not previously been amenable to a hidden motion detector.

In addition, the invention provides a mechanism for mechanically adjusting the range and responsiveness of the motion detector notwithstanding the small size of the space available for housing the detector.

Other aspects, advantages, and novel features of the invention are described below or will be readily apparent to those skilled in the art front the following specifications and drawings of illustrative embodiments.

DETAILED DESCRIPTION OF ILLUSTRATIVE EMBODIMENTS

Figure 1:
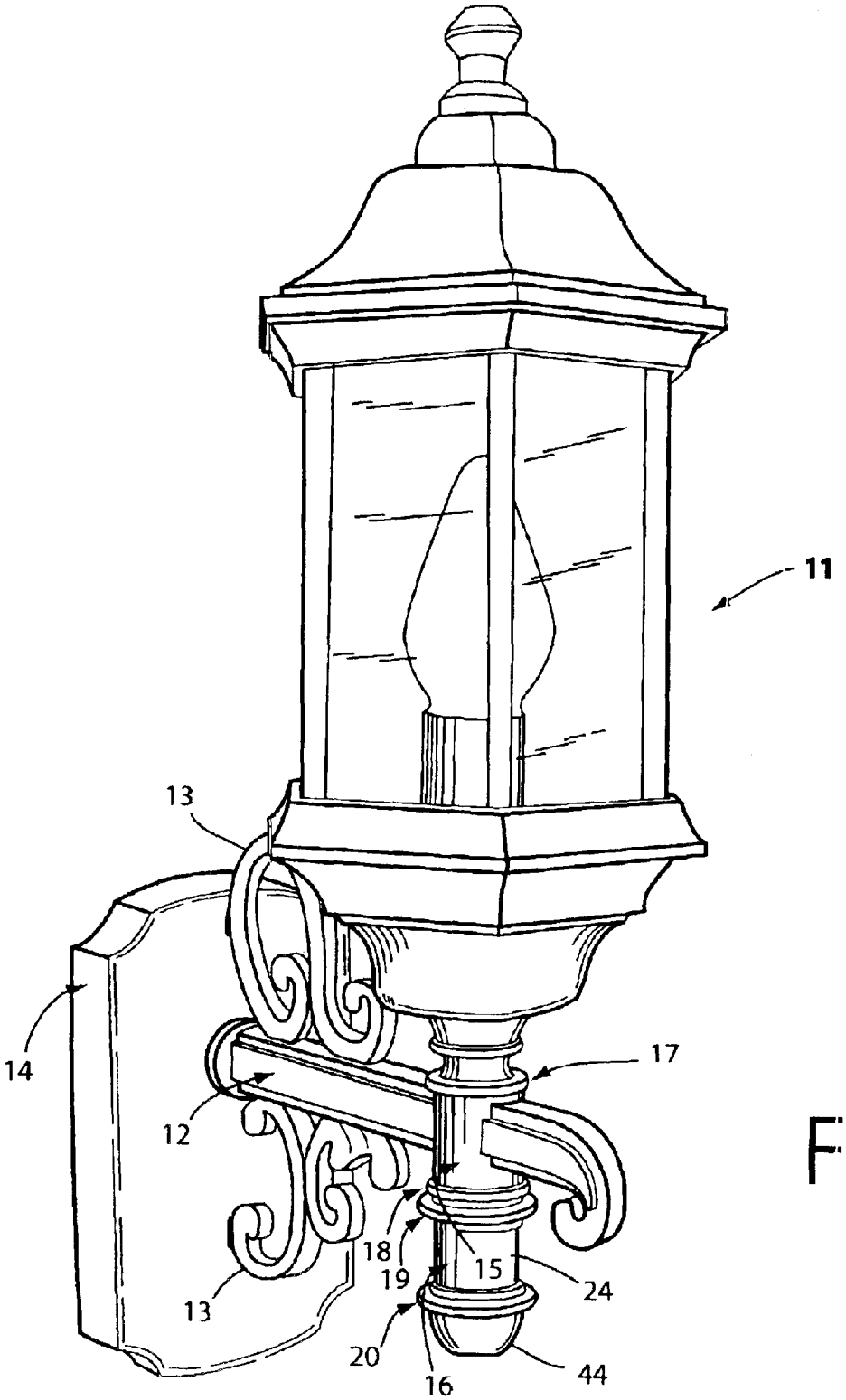
FIG. 1 is an overall perspective view of a decorative lantern incorporating a motion detector according to the invention.

FIG. 1 shows a decorative lighting fixture including a motion detector integrated into the lighting fixture in a completely inconspicuous manner so as not to degrade the stylistic integrity of the fixture. The lighting fixture includes a decorative lantern 11, a decorative support arm 12 with decorative embellishments 13 for supporting lantern 11, and a backplate or base 14 for mounting the lighting fixture on a wall. Support arm 12 is connected to the lantern through a decorative connective element 15. The lantern also includes a decorative assembly 16, which serves here as a motion detector housing.

The decorative assembly 16 illustrated in FIG. 1 is of the form of a small cylindrical element in the same general size and style as decorative connective element 15. The decorative elements 15 and 16 have an outside diameter on the order of a little over one inch (about one and one-eighth inch. The two elements 15 and 16 are adorned with decorative rings 17–20 so as to maintain integrity of style. Such stylistic elements or variations of them are found in a number of historic lantern styles. It has been discovered that a practical motion detector arrangement may be achieved within such small decorative elements while maintaining stylistic integrity, and thus a hidden motion detector can be integrated into in a greater variety of decorative lanterns than previously had been possible.

Figure 2:
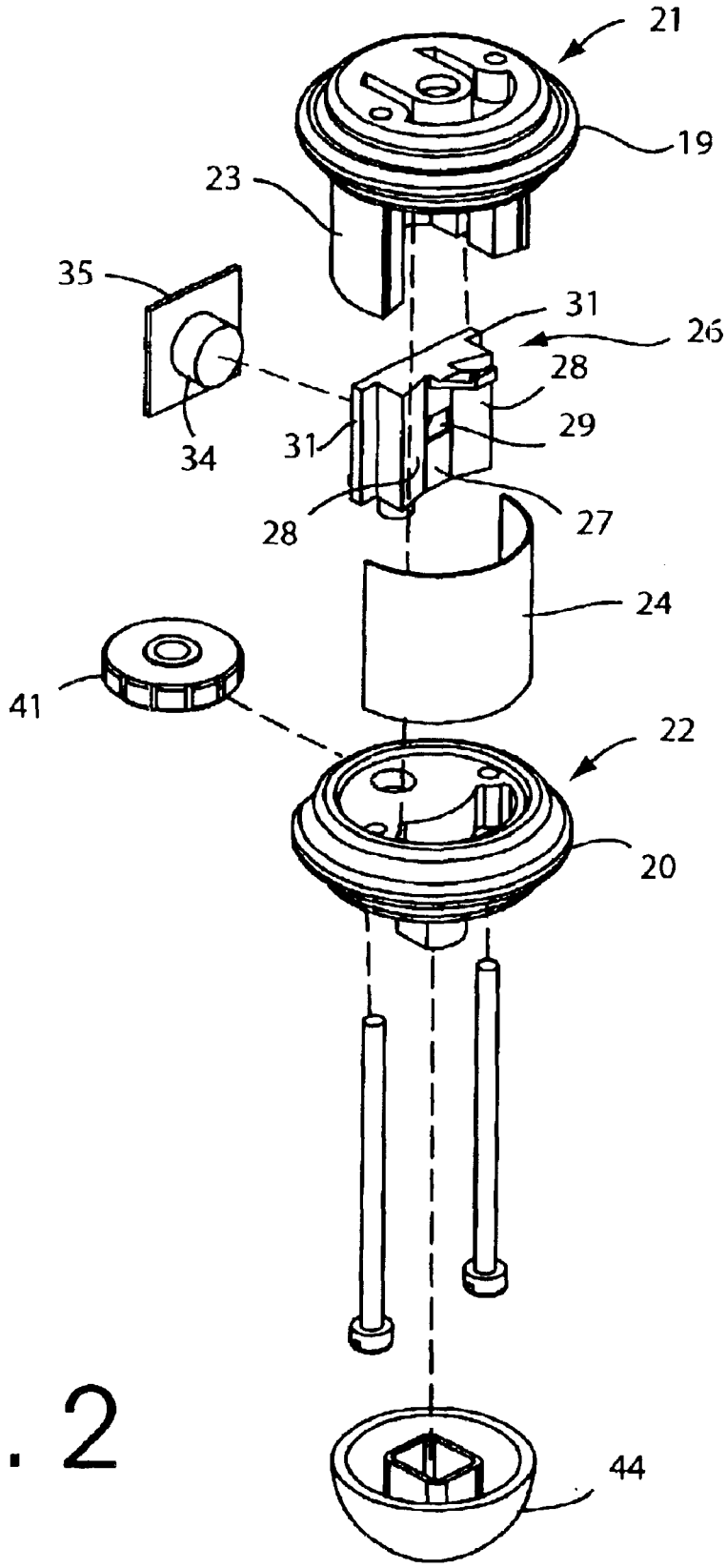
FIG. 2 is an exploded view of an embodiment of motion detector assembly according to the invention including a mechanism for adjusting the range/responsiveness.

Motion detector housing 16 includes a generally cylindrical, wall that is interposed between housing top and bottom portions 21 and 22, which in the configuration illustrated here have protruding annular edges forming the decorative rings 19 and 20. As may be seen in FIG. 2, the cylindrical wall of motion detector housing 16 is composed of a solid portion 23 and a lens portion 24. Here the lens portion forms somewhat less than about one-half of the motion detector cylindrical wall. More specifically, in the illustrated embodiment the lens portion subtends a horizontal angular spread of at least about 160 degrees and may be greater. This means that the motion detector will be able to detect motion in a range greater than 160 degrees. Depending on the lens design, a practical field of view of about 180 degrees can be achieved.

Lens portion 24 comprises a flexible plastic segmented Fresnel lens. Segmented plastic Fresnel lenses are well known in the art. They are formed from a thin sheet of plastic material, on which are formed a number of individual Fresnel lens segments or lenslets. The sheet is usually flexible, although it may also be pre-formed to a particular shape. Fresnel lenses for use in motion detectors are fabricated by a number of vendors, for example, Fresnel Technologies, Inc. of Fort Worth, Tex.

Here the thin plastic sheet is formed into a portion of the cylindrical wall. The individual lenslets may be seen at reference numerals 46 in FIG. 3. The cylindrical wall and top and bottom portions 21 and 22 define a compact cylindrical interior region roughly 26 millimeters (mm) in diameter and roughly 22 mm high. Within this region is housed a very effective motion detector providing good range, two or three levels of vision, and a mechanical adjustment mechanism for vertical adjustment of the levels of vision.

Within the cylindrical volume is a plastic carrier member 26 having a front face formed of a central panel 27 and two angularly positioned side panels 28 disposed so that the central panel is set back from the leading edges of the side panels by roughly 2 millimeters. Central panel 27 is formed with a window 29 for exposing PIR sensor elements positioned behind the window. The edges 31 of carrier member 26 extend laterally beyond the body of the carrier member and serve as guides for guiding vertical movement of the carrier member in the assembled motion detector housing. Edges 31 ride in grooves 32 (visible in FIG. 3) in the interior wall of solid portion 23. The rear side of carrier member 26 is formed with a recess 33 generally shaped to receive a PIR sensor chip 34 of the type that is commercially available and commonly used in motion detector applications. Sensor chip 34 includes a pair of side-by-side sensing elements. Window 29 is sized and positioned to overlie the sensing elements on chip 34. A small printed circuit board 35 roughly 2.2 cm by 1.6 cm for chip 34 abuts against the rear side of carrier member 26. Chip 34 is mounted on the front side of board 35.

In the illustrated embodiment carrier member 26 is disposed to lie in only one half of the compact interior cylindrical region defined by the motion detector housing. Nevertheless, the carrier member is small enough to leave a void behind the printed circuit board. This void allows a few small electronic components to be mounted on the back of the printed circuit board. In addition, electrical leads 3 carrying the signal from PIR chip 34 are routed into the void and pass through central bore 38 in top portion 21 where the leads may be directed to further motion detector circuitry in known manner. For example, it is known to provide a second printed circuit board with further circuitry mounted in backplate 14.

Sensor chip 34 may be mounted in a fixed position in the compact interior region. For fixed chip mounting any form of mounting arrangement may be used that avoids the optical pathways from the Fresnel lenslets. Those of routine skill in the art will be able to mount a sensor chip in fixed position in the compact interior region, given the motivation to do so taught herein. The carrier member described above, however, does not provide a fixed mounting because the carrier member itself is mounted for movement by virtue of edges 31 riding in grooves 32.

To effect the movement, a threaded plastic rod 39 on the bottom of carrier member 26 extends through bore 40 in bottom portion 22 into a recessed region in the bottom portion sized and shaped to receive a plastic thumbscrew 41 with mating internal threads. The top edge of carrier member 26 is formed with an integral plastic spring member 42 that angles upward and forward from the carrier member to abut against the underside of top portion 21. The distal end of spring member 42 is formed with a small surface for engaging top portion 21 without binding. Two screws 43 extend through the bottom and top portions to hold the motion detector housing together without interfering with the operation of thumbscrew 41 or with movement of carrier member 26. The illustrated embodiment includes a decorative end cap 44 on the underside of the motion detector housing that covers the ends of screws 43. Other decorative shapes such as a decorative tailpiece could also be used.

Figure 3:
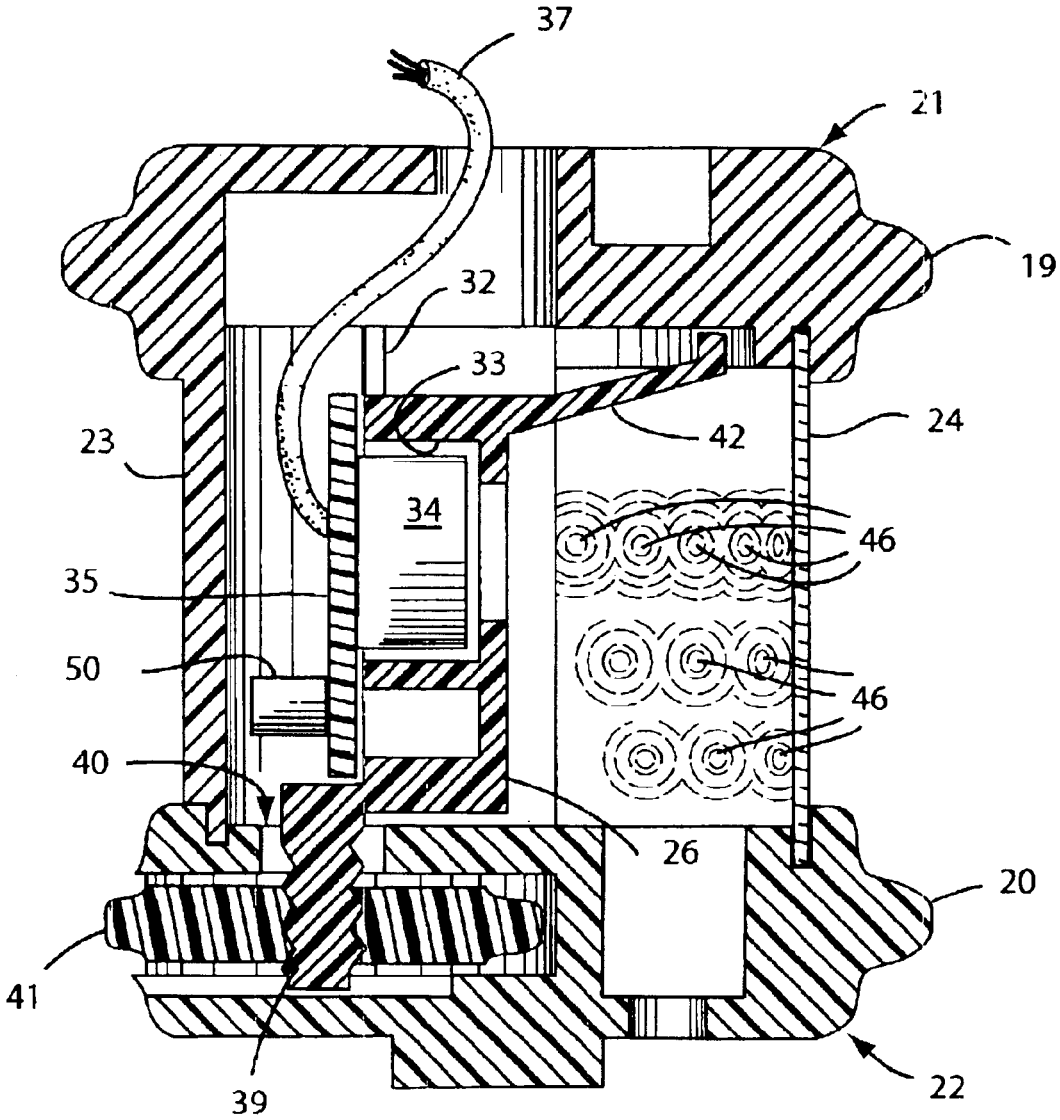
FIG. 3 is a cross-sectional view of the motion detector assembly of FIG. 2.
Figure 4A:
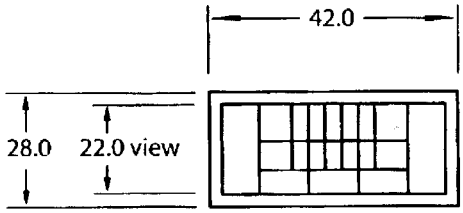
FIG. 4A is a lens diagram for a segmented Fresnel lens for use in the motion detector of FIG. 2.
Figure 4B:
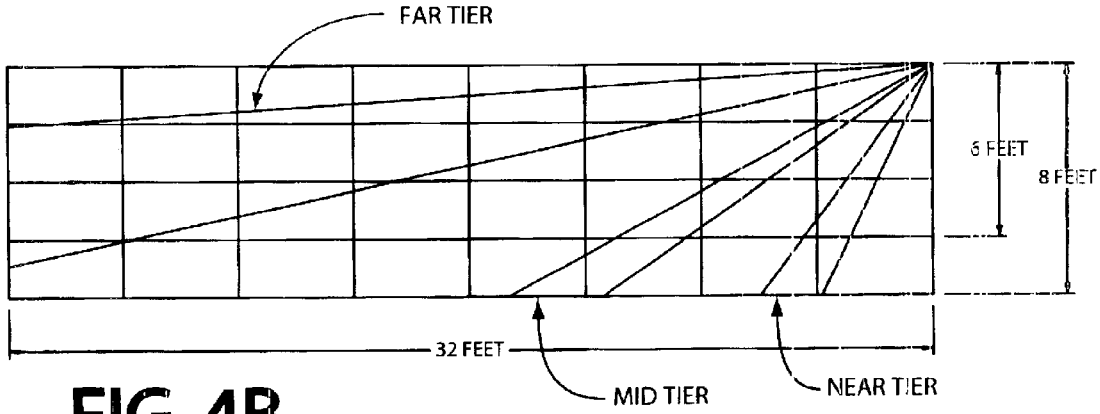
FIG. 4B is a tier diagram for zone range for the motion detector of FIG. 2.

Fresnel lens 24 is formed with a number of lenslets illustrated diagrammatically at 46 in FIG. 3. The Fresnel lenslets direct infra-red radiation from a target in the field of view through window 29 to the sensing elements in chip 34. As is known, a configuration of this sort defines a plurality of zones in the field of view and chip 34 detects infra-red radiation from a target in motion as it enters or leaves a zone. FIG. 3 shows three levels of lenslets, which generate a far detection zone, a mid detection zone and a near detection zone. FIG. 4A shows an approximate lenslet lay out on the segmented lens 24. The dimensions in FIG. 4A are in millimeters. FIG. 4B shows the approximate zones generated by the lenslet layout of FIG. 4A When sensor 34 is in a given vertical disposition with respect to the Fresnel lenslets.

In operation, thumbscrew 41 may be turned to raise or lower carrier member 26 in the vertical direction. This movement of the carrier member produces a very slight adjustment in the position of sensor chip 34 with respect to the Fresnel lenslets and this in turn serves to aim the detection zones at a higher or lower position. Spring member 42 provides an effective amount of tension on carrier member 26 and thumbscrew 41 so that the position exhibits minimal slippage and is easy to adjust with a good range of motion of the thumbwheel to produce the desired amount of movement of the carrier member.

Although the compact interior region of the motion detector housing is quite crowded, since it must allow for a movable carrier member mechanism as well as provide sufficient room for the optical pathways, it is still possible to include an onboard filtering circuit on printed circuit board 35. This will generally comprise a capacitor and resistor network that filters out low frequency noise from the low-voltage power supply line that powers the sensor chip. This is advantageous in that the leads 37 from the sensor chip to the secondary motion detector circuitry are particularly susceptible to picking up such noise as they wind back to the secondary printed circuit board. Providing the RC filter circuit in the motion detector housing at the sensor chip helps to reduce the noise.

Figure 5:
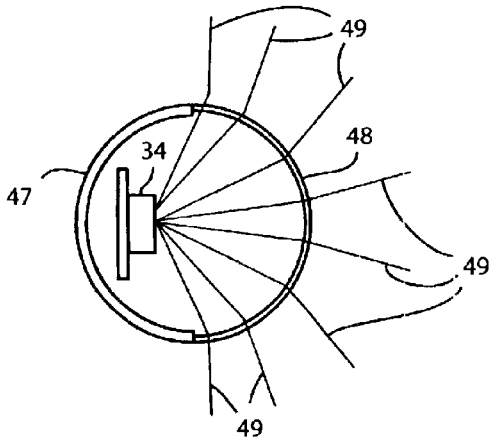
FIG. 5 is a plan view showing an alternative sensor placement in the motion detector housing.

FIG. 5 shows an alternative placement of the sensor chip 34 in the motion detector housing. In FIG. 5 the front of the sensor chip, that is, the entrance window through which the infra-red radiation enters the sensor, is displaced back from the center of the cylindrical housing so that it is proximal to a rear wall 47 of the housing and distal to the lens member 48. In this configuration the entrance window is spaced from the lens member by greater than the radius of the cylindrical housing, that is, by greater than one-half of the characteristic transverse dimension of the cylinder. Several representative ray paths 49 are shown impinging on one of the sensor elements in the chip 34. With this arrangement the ray paths within the compact interior region between the lenslets and the sensor are longer than the cylindrical radius. This allows for the lenslets to have longer focal lengths than they could if the sensor were positioned with the entrance window roughly at the center of the cylindrical region. While this arrangement is advantageous in that it allows for longer focal lengths even in the crowded compact interior region, the lenslets will generally have different focal lengths since the optical pathlengths will be different for lenslets at different positions around the cylindrical lens portion. When the sensor is placed so that the sensor entrance window is at the center of the cylindrical lens portion, then the optical pathlengths will all be the same, about equal to the cylindrical radius, and this provides for easier and hence less costly lens fabrication. Thus, while the acentric mounting of the sensor in the cylindrical housing leads to longer focal lengths, it also generally requires more difficult and hence more costly lens fabrication.

Notwithstanding the small size of the motion detector housing disclosed herein, it is still possible to achieve a wide angle of coverage. In general, a wide angle is considered here to be 150 degrees or greater. This is a step up from common motion detectors of the prior art that are limited to 120 degrees. While other prior art motion detectors have achieved 150 degrees of coverage or more, them have not done so in the small-scale decorative housing disclosed here.

Although a generally cylindrical motion detector housing has been shown here for purposes of illustration, it is not necessary that the shape be precisely cylindrical. As mentioned above, a cylindrical wall is optically advantageous in that, when the sensor window is disposed roughly at the center of the cylindrical wall, the lens portion of the wall can have lenslets of equal focal length, being roughly equal to radius of the cylinder, providing for simpler, less costly lens fabrication. Nevertheless, alternative shapes may also be used with appropriate changes in lenslet design for the optical paths formed by using such alternative shapes. In addition, where the motion detector housing departs from a cylindrical shape to the extent a cylinder diameter is not a well defined quantity, the size of the compact interior region may be measured by any appropriate characteristic transverse dimension, where transverse means here the direction perpendicular to the vertical axis of the lantern. A maximum characteristic transverse dimension size of about 28 mm is chosen as significant here because that leads to a motion detector housing having an external size that agrees with the maximum size for a style of decorative cylinders or other solids of revolution found in many decorative lantern designs that have heretofore eluded the motion detector.

Some decorative lantern designs employ a bulging cylindrically shaped decorative element, that is, a cylinder that bulges outward at its center plane. Others use a constricted cylindrical shape that squeezes inward at the center plane, generally forming a hyperboloid of revolution. These shapes may be approximated with lens portions composed of one or more truncated conical sections and/or cylindrical bands. The constricted cylinder can be approximated for example by an upper conical portion, a central cylindrical portion and a lower conical portion.

The above descriptions and drawings are given to illustrate and provide examples of various aspects of the invention in various embodiments. It is not intended to limit the invention only to these examples and illustrations. Given the benefit of the above disclosure, those skilled in the art may be able to devise various modifications and alternate constructions that although differing from the examples disclosed herein nevertheless enjoy the benefits of the invention and fall within the spirit and scope of the invention, which is to be defined by the following claims.

What is claimed is:

1. A decorative lighting fixture activated by an infra-red motion detector for monitoring motion in a monitored region, wherein the motion detector includes a motion detector housing having a decorative external appearance and disposed to form an integral part of the lighting fixture, an infra-red sensor disposed within the housing, and a segmented Fresnel lens member for directing infra-red radiation from the monitored region to the infra-red sensor, wherein the lighting fixture is characterized in that:

said motion detector housing and said segmented Fresnel lens member define a compact interior region having a characteristic transverse dimension of at most 28 mm;

said infra-red sensor is mounted in said compact interior region; and said lens member is structured and disposed in said motion detector housing to direct infra-red radiation to said sensor from a plurality of zones in said monitored region, said plurality of zones having a horizontal angular field of view of at least 150 degrees.

2. The apparatus of claim 1 wherein said motion detector housing and said segmented Fresnel lens member define a generally cylindrical portion and said characteristic transverse dimension is an inside diameter of said generally cylindrical portion.

3. The apparatus of claim 2 wherein said sensor has an entrance window for infra-red radiation and said sensor is disposed such that said entrance window is positioned at the transverse center of said generally cylindrical portion.

4. The apparatus of claim 3 wherein said lens member is structured and disposed to define at least two vertical levels of vision.

5. The apparatus of claim 4 wherein said lens member is structured and disposed to define at least three vertical levels of vision.

6. The apparatus of claim 3 wherein said lens member is structured and disposed to define a plurality of zones having an effective horizontal angular field of view of at least 160 degrees.

7. The apparatus of claim 6 wherein said lens member is structured and disposed to define at least three vertical levels of vision.

8. The apparatus of claim 1 wherein said lens member is structured and disposed to define at least two vertical levels of vision.

9. The apparatus of claim 8 wherein said lens member is structured and disposed to define at least three vertical levels of vision.

10. The apparatus of claim 8 wherein said characteristic transverse dimension is at most about 26 mm.

11. The apparatus of claim 1 wherein said lens member is structured and disposed to define a plurality of zones having an effective horizontal angular field of view of 160 degrees.

12. The apparatus of claim 1, wherein said sensor has an entrance window for infra-red radiation and said sensor is disposed in said compact interior region proximal to a rear wall of said housing and distal to said lens member, whereby said entrance window is spaced from said lens member by greater than one-half of said characteristic transverse dimension.

13. The apparatus of claim 1, wherein a filter circuit for said sensor is mounted in said compact interior region along with said sensor.

14. A decorative lighting fixture activated by an infra-red motion detector for monitoring motion in a monitored region, wherein the motion detector includes a motion detector housing having a decorative external appearance and disposed to form an integral part of the lighting fixture, an infra-red sensor disposed within the housing, and a segmented Fresnel lens member for directing infra-red radiation from the monitored region to the infra-red sensor, wherein the lighting fixture is characterized in that:

said motion detector housing and said segmented Fresnel lens member define a generally cylindrical portion with an interior region having a characteristic transverse dimension of at most about 28 mm;

said infra-red sensor is mounted in said interior region;

said lens member is structured and disposed in said motion detector housing to direct infra-red radiation to said sensor from a plurality of zones in said monitored region, said plurality of zones having a horizontal angular field of view of at least 160 degrees;

wherein said lens member is structured and disposed to define at least three vertical levels of vision.

* * * * *